United States Patent [19]
Takahashi
[11] 4,210,239
[45] Jul. 1, 1980

[54] FOLDABLE NEEDLE PACK

[75] Inventor: Masamitsu Takahashi, Hiroshima, Japan

[73] Assignee: Bankoku Needle Manufacturing Company Ltd., Hiroshima, Japan

[21] Appl. No.: 947,947

[22] Filed: Oct. 2, 1978

[30] Foreign Application Priority Data

Mar. 23, 1978 [JP] Japan ..... 53-37828[U]

[51] Int. Cl.³ ..... B65D 85/24
[52] U.S. Cl. ..... 206/45.13; 206/382
[58] Field of Search ..... 206/45.13, 45.11, 45.23, 206/45.2, 45.24, 380, 382, 383, 365, 366, 443, 371, 379, 329, 331

[56] References Cited

U.S. PATENT DOCUMENTS

| | | | |
|---|---|---|---|
| 1,130,811 | 3/1915 | Goldsmith | 206/371 X |
| 3,074,540 | 1/1963 | Beich et al. | 206/366 |
| 3,075,639 | 1/1963 | Lingley | 206/366 |
| 3,710,977 | 1/1973 | Van den Enden et al. | 206/455 X |
| 3,904,031 | 9/1975 | Kessler | 206/331 X |
| 3,951,263 | 4/1976 | Vale | 206/382 |

FOREIGN PATENT DOCUMENTS

| | | | |
|---|---|---|---|
| 1169244 | 10/1969 | United Kingdom | 206/382 |

*Primary Examiner*—Joseph Man-Fu Moy
*Attorney, Agent, or Firm*—George A. Loud

[57] ABSTRACT

A foldable needle pack comprises a base member, which is created or scored so as to present a fold line comprising a first base portion and a second base portion bordered by the fold line, a needle holder portion mounted near the fold line on the second base portion, and two closely aligned rigid transparent cover members, each formed as a hollow shell wherein the first cover member is at the end edge thereof opposite its open side attached to the first base portion while the second cover member is at the peripheral edge attached on the second base portion whereby when the first base portion is bent back along the fold line relative to the second base portion, the top of each of needles slides on the inner surface of the first cover member and then a free end edge of the first cover member comes into friction contact with the side of the needles to hold the needle pack V-shaped.

3 Claims, 6 Drawing Figures 10
27
28
30
31
32
33
34
35
36
37
38
39
40
40a

FOLDABLE NEEDLE PACK

BACKGROUND OF THE INVENTION

The present invention relates to a foldable needle pack and more particularly to a foldable needle pack which is easy to draw a desired needle kept therein.

Conventional needle packages comprise a sheet cover having a holder portion, and a small card in which a plurality of needles are kept, suitably wrapped by the sheet cover in such a manner it is removably fitted over the holder portion of the sheet cover.

In use, after the sheet cover is opened, the small card is drawn from the holder portion of the sheet cover thereafter to remove a desired one of needles from the card.

However, with the above conventional needle packages they tend to get infirm or out of shape because of the fact that both the sheet cover and the card are of paper after a large number of actions for accommodating the card in the sheet cover and taking out the card from the sheet cover are carried out. Accordingly, a high durability can not be preserved. Moreover, the conventional needle packages are not easy to handle due to the fact which includes troublesome steps comprising opening the wrapping of the sheet cover, drawing the card from the holder portion of the sheet and removing the desired one of needles from the card as stated above. Furthermore, another drawback is also pointed out. The sheet cover is usually provided with an opening for observing the needles supported by the card from outside. However, it is impossible to observe the back of the needles which do not face to the window. For this, users are apt to overlook rust, crack and discoloration occurred in the needles.

SUMMARY OF THE INVENTION

With the above in mind, an object of the present invention is to provide a foldable needle pack which is easy to draw a desired needle kept therein by holding one half of the pack and applying small force to the free end of the other half of the pack.

Another object of the present invention is to provide a foldable needle pack which has high durability in use.

Another object of the present invention is to provide a foldable needle pack of which fabricating cost is reduced.

Another object of the present invention is to provide a foldable needle pack which is easy to observe preserving condition of needles from outside.

In an embodiment of the present invention, there is provided a foldable needle pack comprising a substantially rectangular shaped base member, which is creased or scored so as to present a fold line which serves as a hinge, the base member comprising a first base portion and a second base portion bordered by the fold line, a needle holder portion through which a plurality of needles can be received mounted near the fold line on the second base portion, and two closely aligned rigid transparent cover members, each formed as a hollow shell presenting an open side towards the base member, both the hollow shells presenting another open side towards each other, wherein one hollow shell is at the end edge thereof opposite its open side attached to the first base portion such that it normally contacts resiliently at its peripheral edge facing the base member with the first base portion while the other hollow shell is at the peripheral edge attached on the second base portion, whereby when the first base portion is bent back along the fold line relative to the second base portion in such a manner that the angle between the surfaces of the base member on which the cover members are mounted increases, the top of each of needles kept in the second cover member slides on the inner surface of the first cover member and then a free end edge of the first cover member comes into friction contact with the side of the needles thereby to hold the needle pack V-shaped.

The feature and advantages of a needle pack according to the present invention will become more apparent from the following description taken in conjunction with the accompanying drawings, in which:

FIG. 1 is a perspective view which schematically illustrates a preferred embodiment of a foldable needle pack according to the present invention, FIG. 2 is a side elevation of FIG. 1, FIG. 3 is a perspective view which schematically illustrates a base member on which a needle holder portion is mounted, shown in FIG. 1, FIG. 4 is a perspective view which schematically illustrates two transparent cover members shown in FIG. 1, FIG. 5 is a perspective view which illustrates a foldable needle pack employed in the present invention, wherein a first base portion is bent back relative to a second base portion to hold the needle pack inversed V-shaped, and FIG. 6 is a side elevation of FIG. 5.

In these drawings, the same reference numerals indicate the same or similar element of the foldable needle pack according to the present invention.

DETAILED DESCRIPTION OF THE PREFERRED EMBODIMENT OF THE INVENTION

Figures 1, 2, 3, 4, 5, 6:
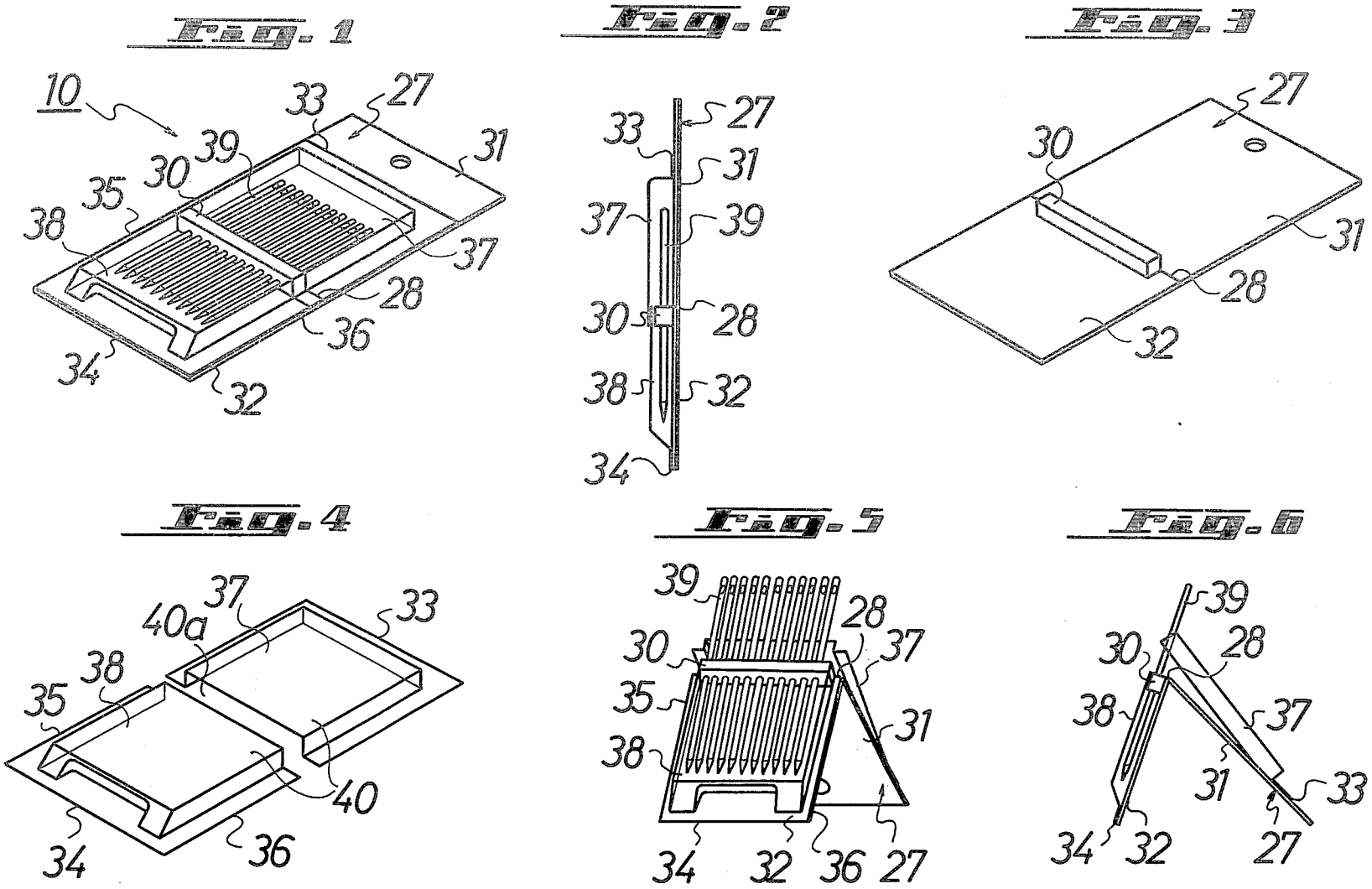

FIG. 1 shows a foldable needle pack, designated by reference numeral 10, employed in the embodiment of the present invention wherein the needle pack comprises a card 27 serving as a base member and creased or scored so as to present a fold line 28, a needle holder portion 30 through which a plurality of needles 39 are kept, and a rigid transparent cover 40 formed as a hollow shell, which comprises two closely aligned cover members 37 and 38, which components will be referred to later in more detail.

Referring to FIG. 3, the substantially rectangular shaped base member 27 is creased or scored so as to present the fold line 28 which serves as a hinge. The fold line 28 is located near the substantially middle portion with respect to the longitudinal direction of the base member 27 in the embodiment of the present invention. The base member 27 comprises a first base portion 31 and a second base portion 32 bordered by the fold line 28. The needle holder portion 30 of synthetic blister resin is mounted near the fold line 28 on the second base portion, wherein the synthetic blister resin may be any one of polystyrene, polyethylene and synthetic rubber. Reference is now made to holding needles 39 to the needle holder portion 30. It is sufficient to directly stick needles 39 into the holder portion 30 or to provide a plurality of cuts or notches at constant intervals therein to insert the needles thereinto, resulting in holding the middle portion of each of needles between cuts and notches.

As shown in FIG. 4, the transparent cover 40 of synthetic resin comprising two closely aligned transparent cover members 37 and 38, each of which is formed as a follow shell presenting an open side towards the base member 27 and both of which presents another open side 40*a* towards each other.

The one hollow shell 37 is at the end edge thereof, designated by reference numeral 33, opposite its open side 40*a* attached to the first base portion such that it normally contacts resiliently at its peripheral edge facing the base member 27. The other hollow shell 38 is at the peripheral edge attached on the second base portion 32. The peripheral edge comprises opposite parallel side edges 35 and 36 and end edge 34 opposite its open side.

The transparent cover of synthetic resin may be made of any one of polyvinyl chloride, polyamide, polyester and acrylic acid resin. Further, the rigid transparent cover 40 may be colorless or colored. In use, hold the needle pack 10 in one hand and then lightly push backwardly the upper end edge 33 of the first base portion 31, so that the top of each of needles kept in the second base member 32 slides on the inner surface of the first cover member 37 and then a free end of the first cover member 37 comes into friction contact with the sides of the needles thereby to hold the needle pack in an inverted V-shape as shown in FIG. 5. Accordingly, a thread (not shown) may be run through the needles eye of a desired one of needles 39.

The closing of the needle pack after the completion of sewing work comprises the steps of accommodating needles 39 in the holder portion and applying small force to the end edge of the first base portion 31 with one hand so as to raise it upwardly while holding the end edge of the second base portion with the other hand. Thus, the needle pack 10 is turn back from the bent position to the initial position which the first base portion 31 is alligned to the second base portion 32, resulting in closing thereof.

As will be obvious from the foregoing description, following advantages will accrue.

a. With the foldable needle pack according to the present invention, it is quite easy to draw a desired needle kept therein by holding one half of the pack and applying small forth to the free end of the other half of the pack.

b. Since the foldable needle pack 10 is hold inversed V-shaped, it can mount on any horizontal portion such as sewing table. Moreover, since the needles 39 are supported having inclined relation with respect to the horizontal portion by the inversed V-shaped pack, it is easy to run a thread through the needle eye of each of needles supported on the needle holder portion.

c. Since the needle holder portion 30 is made of the synthetic blister resin, it has preferable strength as compared with conventional one made of paper. Therefore, the needle holder portion 30 is completely free from getting out of shape to ensure a high durability in use.

d. Since the cover member 40 is made of transparent materials, such as synthetic resin, it is easy to observe the preserving condition of whole appearance of needle kept in the needle pack from outside. This ensures the meintenance of needles to be easy. In other words, the undesirable change, such as rust, crack or discolaration which may occur on the needles can be easily observed from outside of the needle pack 10 without opening the needle pack 10. Accordingly, consumers or users can easily obtain high performance of needles.

e. Since it is unnecessary to use the sheet cover having a complicated pattern, a reduction in fabricating cost will be expected.

It is to be noted that modification and variation of the embodiments of the invention disclosed herein may be resorted to without departing from the spirit of the invention and the scope of the appended claims.

What is claimed is:

1. A foldable needle pack comprising:

(a) a substantially rectangular shaped base member, which is creased or scored so as to present a fold line which serves as a hinge, said base member comprising a first base portion and a second base portion bordered by said fold line, (b) a needle holder portion through which a plurality of needles can be received mounted near said fold line on said second base portion, and (c) two closely aligned rigid transparent cover members, each formed as a hollow shell presenting an open side towards the base members, both said hollow shells presenting another open side towards each other, wherein one hollow shell is, at the end edge thereof opposite its open side, attached to said first base portion such that it normally contacts resiliently, at its peripheral edge facing said base member, with said first base portion while the other hollow shell is at the peripheral edge attached on said second base portion, said cover member attached to said first base portion being of a length whereby, when said first base portion is bent back along said fold line relative to said second base portion in such a manner that the angle between the surfaces of said base members on which said cover members are mounted increases, the top of each of the needles kept in the second cover member slides on the inner surface of said first cover member and then a free end edge of said first cover member comes into friction contact with the side of said needles thereby to hold the needle pack in a V-shape, and whereby the pack is returnable from its frictionally held V-shape to a closed position by applying a small force to the end edge of said first base portion while holding the end edge of the second base portion.

2. A foldable needle pack as defined in claim 1, wherein said needle holder portion is made of synthetic blister resin.

3. A foldable needle pack as defined in claim 1, wherein said first and second transparent cover members are made of synthetic resin.

* * * * *